US009708787B2

(12) United States Patent
Heninger et al.

(10) Patent No.: US 9,708,787 B2
(45) Date of Patent: Jul. 18, 2017

(54) METHOD FOR PRODUCING A CONTIGUOUS ICE BODY IN A GROUND-FREEZING PROCESS

(71) Applicant: LINDE AKTIENGESELLSCHAFT, München (DE)

(72) Inventors: Rolf Heninger, Höhenkirchen-Siegertsbrunn (DE); Ralf Schmand, Unterschleissheim (DE); Rebecca Wallus, Köln (DE); Martin Ziegler, Bensheim (DE)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 15/032,129

(22) PCT Filed: Oct. 16, 2014

(86) PCT No.: PCT/EP2014/002800

§ 371 (c)(1),
(2) Date: Apr. 26, 2016

(87) PCT Pub. No.: WO2015/062705

PCT Pub. Date: May 7, 2015

(65) Prior Publication Data

US 2016/0265181 A1 Sep. 15, 2016

(30) Foreign Application Priority Data

Oct. 30, 2013 (DE) ..... 10 2013 018 210

(51) Int. Cl.
*E02D 3/115* (2006.01)
*E02D 19/14* (2006.01)
(Continued)

(52) U.S. Cl.
CPC ..... *E02D 3/115* (2013.01); *E02D 19/14* (2013.01); *F25B 9/002* (2013.01); *F25B 25/005* (2013.01)

(58) Field of Classification Search
CPC ..... E02D 3/115; E02D 19/14
(Continued)

(56) References Cited

U.S. PATENT DOCUMENTS 3,183,675 A * 5/1965 Schroeder ..... E02D 3/115 165/45
3,220,470 A * 11/1965 Balch ..... E02D 3/115 159/902

(Continued)

FOREIGN PATENT DOCUMENTS

DE 15 01 466 A1 10/1969
DE 31 12 291 A1 10/1982

*Primary Examiner* — Frederick L Lagman
(74) *Attorney, Agent, or Firm* — Philip H. Von Neida

(57) ABSTRACT

The invention relates to a method for producing a contiguous ice body in a ground region, wherein first cooling lances are inserted into the ground region in which the contiguous ice body is to be produced in the presence of a flow of a fluid flow medium flowing through the ground region, in particular in the form of groundwater, wherein a first coolant is introduced into the first cooling lances, and wherein furthermore at least one second cooling lance is introduced into the ground region on a side of the first cooling lances facing the flow and a second coolant, which has a temperature that is lower than the temperature of the first coolant, is introduced into the at least one second cooling lance in order to support the formation of a contiguous ice body that surrounds all of the cooling lances.

13 Claims, 5 Drawing Sheets

(51) Int. Cl.
*F25B 9/00* (2006.01)
*F25B 25/00* (2006.01)

(58) Field of Classification Search
USPC ..... 405/130, 270
See application file for complete search history.

(56) References Cited

U.S. PATENT DOCUMENTS 3,267,680 A * 8/1966 Schlumberger ..... E02D 17/04 165/45
3,720,065 A * 3/1973 Sherard ..... E02D 3/10 175/17
3,943,722 A * 3/1976 Ross ..... E02D 3/115 165/45
5,050,386 A * 9/1991 Krieg ..... E02D 31/00 165/45
5,416,257 A * 5/1995 Peters ..... E02D 19/14 405/128.15
5,507,149 A * 4/1996 Dash ..... B09C 1/00 165/45
5,551,799 A * 9/1996 Dash ..... B09C 1/00 405/128.45
5,730,550 A * 3/1998 Andersland ..... B09C 1/002 210/610
7,516,785 B2 * 4/2009 Kaminsky ..... E21B 36/001 166/242.1
8,267,170 B2 * 9/2012 Fowler ..... E21B 43/2401 166/245
2004/0120772 A1 * 6/2004 Vinegar ..... B09C 1/00 405/128.85
2007/0267190 A1 * 11/2007 Sopko ..... E02D 3/115 166/242.1

* cited by examiner

METHOD FOR PRODUCING A CONTIGUOUS ICE BODY IN A GROUND-FREEZING PROCESS

CROSS-REFERENCE TO RELATED APPLICATIONS

This application claims priority under 35 USC §119 to International Patent Application No. PCT/EP2014/02800, filed on Oct. 16, 2014, which claims priority from German Patent Application DE 10 2013 018210.7, filed on Oct. 30, 2013.

BACKGROUND OF THE INVENTION

The invention pertains to a method for producing a contiguous ice body in a ground freezing process.

In this context, brine cooling is an established and safe ground freezing and foundation soil securing method, which is by all means capable of competing with other methods such as, e.g., concrete injection. However, tests have shown that brine cooling reaches its limits at groundwater velocities above 2 m/day, i.e., a contiguous, monolithic ice body (also referred to as frost body), which encloses all cooling lances, can usually no longer be produced. Among other things, one reason for this is an occurring nozzle effect. The ice body growing around the cooling lances restricts the flow cross sections for the groundwater or flow medium. This in turn increases the flow velocity and the heat flow density at the edge of the ice body. A stationary state, in which the ice body no longer grows, may be reached before a cohesive ice body has formed.

Based on these circumstances, the invention aims to make available a method that makes it possible to produce a contiguous ice body.

This objective is attained by means of a method for producing a contiguous ice body in a around region, wherein first cooling lances are inserted into the around region, in which the contiguous ice body should be produced in the presence of a flow of a fluidic flow medium, particularly in the form of groundwater, flowing through the ground region, wherein a first refrigerant is introduced into the first cooling lances, and wherein at least one second cooling lance is furthermore inserted into the ground region on a side of the first cooling lances facing the flow and a second refrigerant, which has a temperature that is lower than the temperature of the first refrigerant, is introduced into the at least one second cooling lance in order to promote the formation of a contiguous ice body that encloses all cooling lances.

SUMMARY OF THE INVENTION

Accordingly, the inventive met hod for producing a contiguous ice body in a ground region by freezing the ground region or part thereof proposes to insert first cooling lances into the ground region in which the contiguous frost body should be produced in the presence of a flow of a fluidic flow medium, particularly in the form of groundwater, flowing through the ground region, wherein a first refrigerant is introduced into the first cooling lances in order to respectively cool or freeze the ground region, and wherein at least one second cooling lance is furthermore inserted into the ground region on a side of the first cooling lances facing the flow in order to respectively cool or freeze the ground region and a second refrigerant, which has a temperature that is lower than the temperature of the first refrigerant, is introduced into the at least one second cooling lance in order to promote the formation of a contiguous ice body that encloses all first and second cooling lances.

The ice body therefore is presently produced by cooling the ground region, wherein the refrigerants flowing through the cooling lances cool the ground region due to indirect heat exchange such that said ice body is formed by freezing the ground region accordingly, i.e. water present in the ground region is frozen and forms the ice body together with the solids of the ground region frozen therein.

According to the invention, the contiguous ice body being formed encloses all inserted first and second cooling lances participating in the cooling process. In this context, contiguous refers to a contiguous path, i.e. any two points of this ice body can be connected by a path that lies completely in the ice body and does not extend, e.g., through a non-frozen section of the ground region. One potential design of the cooling lances is described further below.

The first refrigerant preferably is a brine, particularly a calcium chloride solution, which may have temperatures in the range of −30° C. to −45° C. The maximum salt content of a calcium chloride solution preferably lies at 30%.

The second refrigerant preferably is liquid nitrogen, in particular, with a temperature of −196° C. (namely at the transition to the gaseous phase under normal conditions).

It is naturally also possible to use alternative first and second refrigerants that approximately have the aforementioned temperatures.

The introduction of the first refrigerant into the first cooling lances and the introduction of the second refrigerant into the second cooling lances preferably take place simultaneously.

Due to the correspondingly lower temperature of the second refrigerant, a cohesive or contiguous ice body can be produced in this case despite the described nozzle effect, wherein the flow of the second refrigerant through the second cooling lances can be advantageously reduced or completely stopped after the initial freezing phase, during which the contiguous ice body is produced.

The invention advantageously provides greater process reliability because contiguous freezing can also be realized at comparatively high flow velocities of up to 6 m/day. This is a decisive advantage, in particular, under unclear circumstances with respect to the groundwater velocity. The initial freezing phase is significantly shortened due to the pre-cooling by means of the second refrigerant. The supplementary costs for the additional cooling by means of the second refrigerant (particularly nitrogen) car, be compensated or even overcompensated with the savings realized due to the shorter initial freezing phase.

The ground in question presently can for the unfrozen state generally be modeled in the form of a three-phase model consisting of solid, water or flow medium and air. Since complete saturation can be assumed for freezing measures, a two-phase model consisting of solid and water or flow medium results for the unfrozen ground. The water phase decreases and the ice phase simultaneously increases during the course of the freezing process or the formation of the ice body, respectively. Experience shows that a noteworthy proportion of unfrozen water for ground solids such as fine sand, coarse sand or gravel already is no longer present at approximately −2° C., wherein this applies, in particular, to the preferred temperatures of the refrigerants used herein (see above).

According to an embodiment of the invention, it is proposed that several second cooling lances are inserted into the ground region on the side of the first cooling lances facing the flow and the second refrigerant is introduced into the second cooling lances. In other words, the additional second cooling lances are positioned on the windward side of the planned contiguous ice body upstream of the first cooling lances.

According to another embodiment of the invention, it is proposed that the first cooling lances are inserted into the ground region adjacent to one another, especially parallel to one another, in a plane in order to produce, in particular, an ice body in the form of a pit wall.

According to another embodiment of the invention, it is proposed that the first cooling lances are inserted into the ground region adjacent to one another, especially parallel to one another, along an imaginary circumferential surface (e.g., in the form of the surface of a cylinder, particularly a circular cylinder) in order to produce, in particular, a frost body in the form of a hollow cylinder or a tunnel section.

Simulation calculations showed that it is advisable to provide one second cooling lance per first cooling lance in regions, in which nozzle effects frequently occur. This is particularly sensible in the center of a plane frost body, e.g. in the form of a pit wall, or a cylindrical ice body, especially a circular-cylindrical ice body, e.g., in the form of a tunnel section.

It is therefore preferred to respectively insert the at least one second cooling lance or the several second cooling lances into the ground region upstream of an assigned first cooling lance referred to a flow direction or flow, wherein the respective second cooling lance particularly extends parallel to the assigned first cooling lance.

BRIEF DESCRIPTION OF THE DRAWINGS

Other characteristics and advantages of the invention are elucidated in the following description of exemplary embodiments of the invention with reference to the figures.

In these figures.

DETAILED DESCRIPTION OF THE INVENTION

Figure 1:
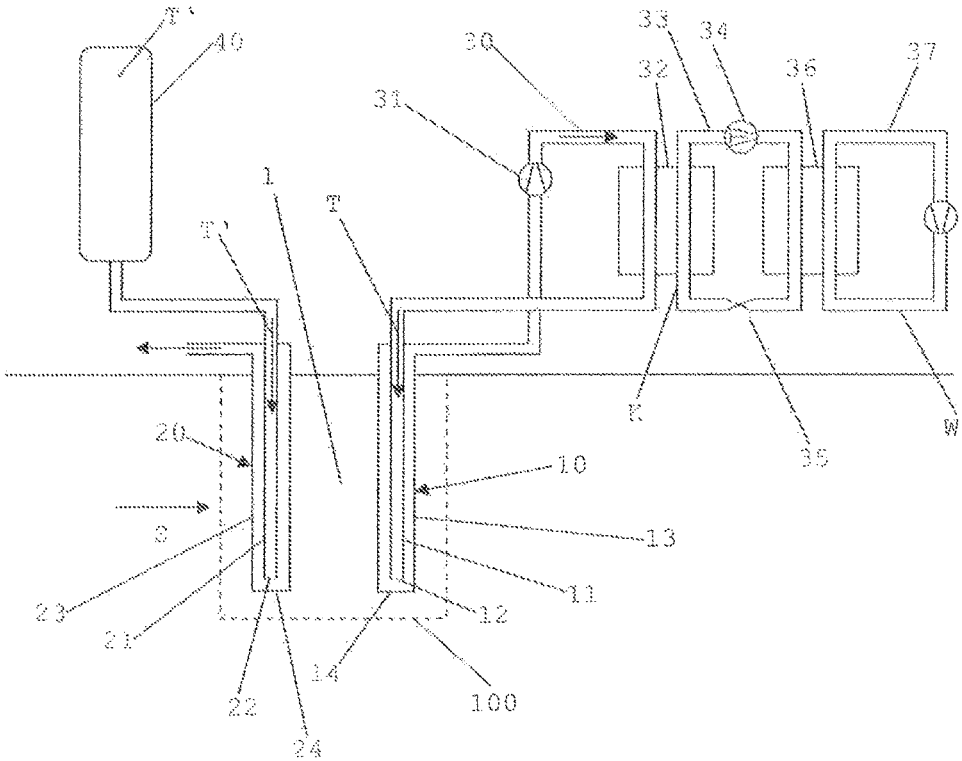
FIG. 1 shows a schematic illustration of a system for carrying out the inventive method.
Figure 3:
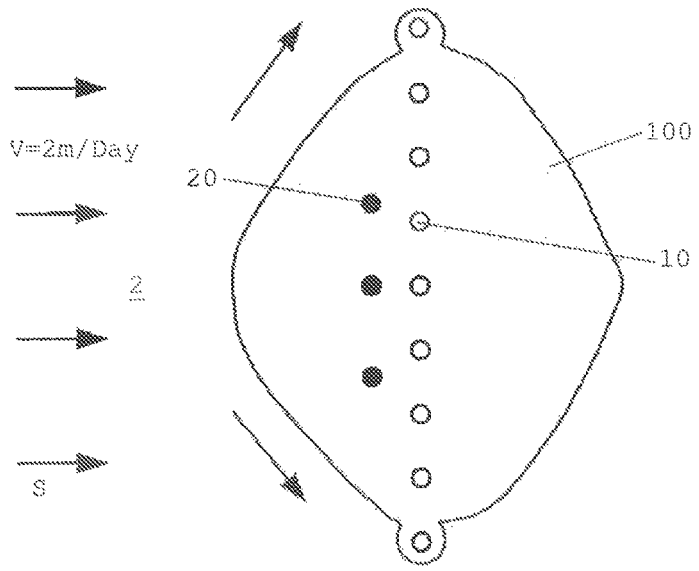
FIG. 3 snows a schematic illustration of the inventive production of a contiguous ice body, particularly in the form of a plane wall (e.g. a pit wall)
Figure 5:
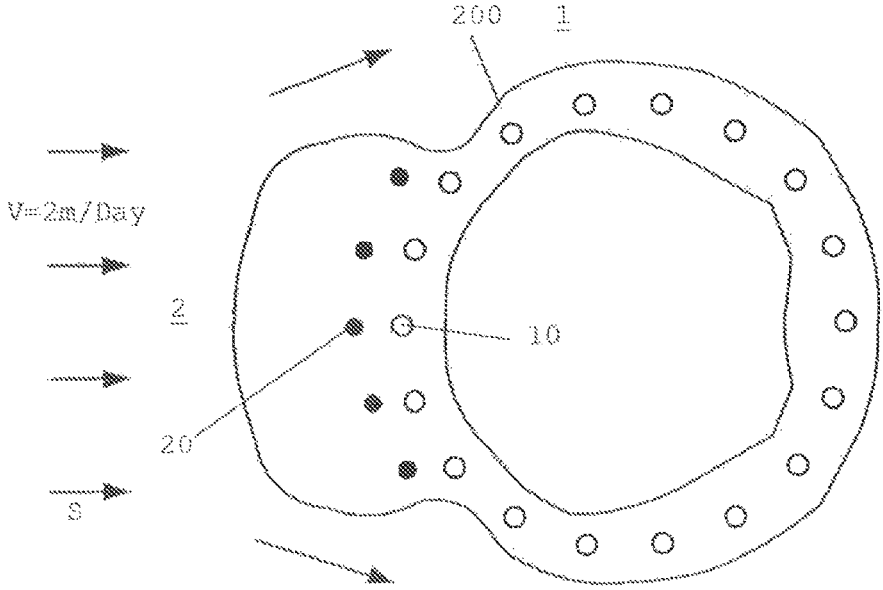
FIG. 5 shows a schematic illustration of the inventive production of a contiguous hollow-cylindrical ice body (e.g. a tunnel section).

FIG. 1 shows a schematic illustration of an inventive system and an inventive method for producing a contiguous ice body or frost body 100, 200 of the type illustrated, e.g., in FIGS. 3 and 5.

Referred to a flow in the form of a groundwater flow in a flow direction S, at least one second cooling lance 20, into which a second refrigerant T' in the form of liquid nitrogen is introduced, is arranged upstream of first cooling lances 10 inserted into the ground region 1, into which a first refrigerant T in the form of a brine solution (e.g. $CaCl_2$) is introduced (these first cooling lances may be inserted into the ground region 1 vertically, as well as horizontally). In an initial freezing phase, during which the contiguous ice body 100, 200 is produced in the ground region 1, the first and the second refrigerant T, T' are simultaneously introduced into the corresponding assigned cooling lances 10, 20. After the formation of the contiguous ice body 100, 200, the flow of the second refrigerant T' (e.g. liquid nitrogen) can be throttled or completely stopped.

In said brine cooling system, the first refrigerant T is introduced into inner tubes 11 of the first cooling lances 10, which are respectively arranged coaxial in an assigned outer tube 13. In this case, the first refrigerant T flows through the respective inner tube 11 until it reaches an opening 12 of the inner tube 11, which lies opposite of an end wall 14 of the respective outer tube 13, is discharged from the respective opening 12 and then flows back in the outer tube 13 surrounding the respective inner tube 11. During this process, the first refrigerant T cools the surrounding ground region 1 due to indirect heat transfer and is subsequently fed into a refrigerant circuit 30, in which the heated first refrigerant T is pumped through a heat exchanger 32 by means of a pump 31, after it was discharged from the respective outer tube 13. In this heat exchanger, the first refrigerant T is cooled by means of a coolant K (e.g. ammonia or COM) circulating in a coolant circuit 33 and then once again introduced into the inner tubes 11 of the first cooling lances 10.

During this process, the gaseous coolant K is heated, compressed in a compressor 34, then cooled once again in a condenser 36 that is thermally coupled to a cooling water circuit 37 and ultimately expanded by means of a throttle 35 and liquefied. This liquid coolant K once again flows into the heat exchanger 32 or evaporator 32 and cools the first refrigerant T therein while it evaporates.

The second cooling lances 12 are preferably realized like the first cooling lances 10, wherein a second refrigerant T' in the form of liquid nitrogen is in this case introduced into the respective inner tube 21 from a liquid nitrogen tank 40, discharged from the respective opening 22, which lies opposite of the end wall 24 of the respective outer tube 23, and then flows back in the respective outer tube 23. During this process, the second refrigerant T' evaporates while it cools the ground region 1, wherein the gaseous phase is discharged from the outer tubes 23 of the second cooling lances 20 and, e.g., subsequently discarded.

Figure 2:
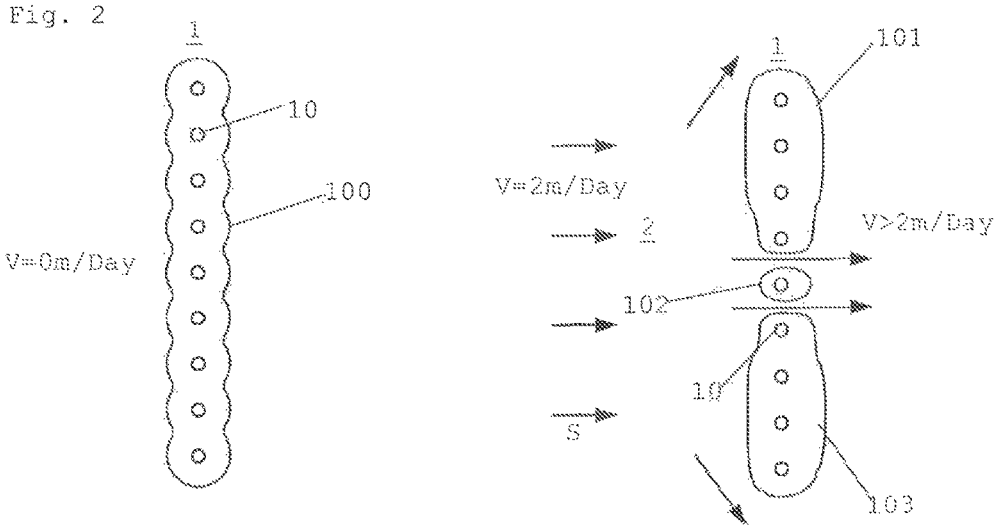
FIG. 2 shows the production of a contiguous ice body in the form of a plane wall (e.g. a pit wall with brine cooling at a diminishing groundwater flow (left), as well as at a groundwater flow around V=2 m/day that prevents the formation of a contiguous ice body due to a nozzle effect (right)

At groundwater flow velocities V above 2 m/day, brine cooling alone no longer makes it possible to produce a contiguous ice body 100, which encloses all first cooling lances 10 as illustrated in FIG. 2 (left), with a parallel arrangement of first cooling lances 10 along a plane as illustrated in FIG. 2, namely due to a nozzle effect that occurs, in particular, in the center between adjacent first cooling lances 10 (at this location, the flow velocity V is substantially higher than 2 m/day due to the nozzle effect). In fact, a configuration, for example, with three non-contiguous ice bodies 101, 102, 103 is formed, in which a central ice body 102 only encloses a central first cooling lance 10.

An inventive contiguous ice body 100 can also be produced in the ground region 1 (see FIG. 4) at a groundwater flow velocity of V=2 m/day with additional cooling by means of second cooling lances 20, into which—as described above—a second refrigerant T' in the form of liquid nitrogen is introduced. For this purpose, the second cooling lances 20, especially three second cooling lances 20, are centrally arranged upstream of the first cooling lances 10 referred to the flow direction S, i.e. on the side 2 of the planned ice body 100 facing the flow, particularly at a distance of approximately 1 m from the plane defined by the first cooling lances 10. The clearance between the first cooling lances 10 preferably amounts to 0.8 m. The clearance between the second cooling lances 20 preferably amounts to 0.6 m to 1 m.

Figure 4:
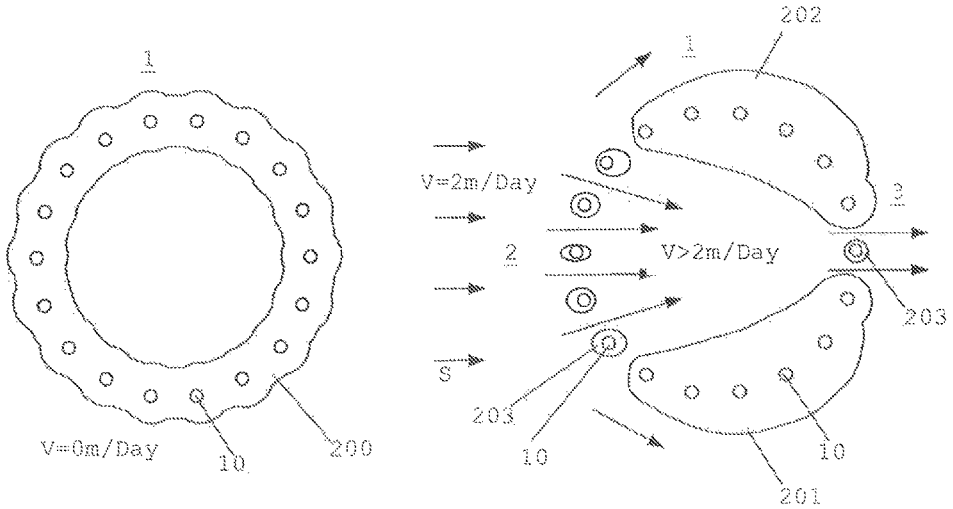
FIG. 4 shows a schematic illustration of the production of a contiguous hollow-cylindrical ice body with brine cooling at a vanishing groundwater flow (left), as well as at a groundwater flow around V=2 m/day that prevents the formation of a contiguous ice body due to a nozzle effect (right)

FIG. 4 shows a phenomenon corresponding to FIG. 2 during the production of a hollow-cylindrical ice body 200. Although this ice body can be produced with brine cooling alone at a diminishing groundwater flow velocity, a nozzle effect once again occurs at a higher groundwater flow velocity around V=2 m/day, particularly between the central first cooling lances 10 on the side facing the flow or the windward side 2 of the cooling lance arrangement 10 and, although to a lesser extent, on the side facing away from the flow or the leeward side 3, if applicable. A potential non-contiguous configuration therefore would consist, e.g., of a plurality of non-contiguous and smaller central ice bodies 203 on the windward side 2 and the leeward side 3, as well as two larger flanking ice bodies 201, 202.

According to FIG. 5, a contiguous ice body 200 can also be produced with a hollow-cylindrical configuration of the first cooling lances 10, namely with additional inventive cooling by introducing a second refrigerant T' into second cooling lances 20 (see above), for example 5 second cooling lances 20 as shown, which once again are respectively arranged upstream of an assigned first cooling lance 10 referred to the flow direction S of the groundwater, particularly at a preferred distance of 1 m to 2 m from the cylinder surface defined by the first cooling lances 10 or from the respectively nearest opposite cooling lance 10. The clearance between the first cooling lances 10 once again preferably amounts to 0.8 m to 1.2 m. The clearance between the second cooling lances 20 preferably amounts to 0.8 m to 1.5 m.

Clearances of 1.0 m generally are common or preferred for second cooling lances 20, into which nitrogen is introduced as second refrigerant T'. Due to the substantially higher temperatures, clearances of 0.8 m are preferred for first cooling lances 10, into which brine is introduced as first refrigerant T. Lower values increase the expenditures and higher values prolong the freezing period. In non-symmetrical frost bodies or in symmetrical frost bodies, in which the cooling lances cannot be positioned symmetrically due to structural circumstances, the clearances of the respective cooling lances 10 and 20 naturally may also deviate among one another and from one another. Preferred clearances between the first and the second cooling lances respectively lie at 1.0 m for straight, wall-like ice bodies (see FIG. 3) and at 1.5 m for a circular cross section (see FIG. 5). In this case, the clearances may by all means be dependent on the geometry of the frost body 100, 200.

LIST OF REFERENCE SYMBOLS

1 Ground region
2 Side facing flow or windward side
3 Side facing away from flow or leeward side
10 First cooling lance
11 Inner tube
12 Opening
13 Outer tube
14 End wall
20 Second cooling lance
21 Inner tube
22 Opening
23 Outer tube
24 End wall
30 Refrigerant circuit
31 Pump
32 Heat exchanger
33 Coolant circuit
34 Compressor
35 Throttle
36 Condenser
37 Cooling water circuit
40 Liquid nitrogen tank
T First refrigerant
T' Second refrigerant
K. Coolant
W Cooling water
S Flow or flow direction

What we claim is:

1. A method for producing a contiguous ice body in a ground region, comprising inserting first cooling lances into the ground region, in which the contiguous ice body should be produced in the presence of a flow of a fluidic flow medium flowing through the ground region, introducing a first refrigerant into the first cooling lances, and furthermore inserting at least one second cooling lance into the ground region on a side of the first cooling lances facing the flow and introducing a second refrigerant, which has a temperature that is lower than the temperature of the first refrigerant, into the at least one second cooling lance in order to promote the formation of a contiguous ice body enclosing all cooling lances.

2. The method according to claim 1, characterized in inserting several second cooling lances into the ground region on the side of the first cooling lances facing the flow and introducing the second refrigerant into the second cooling lances.

3. The method according to claim 1, characterized in simultaneously introducing the first refrigerant and the second refrigerant into the respective cooling lances.

4. The method according to claim 1, characterized in stopping or throttling the introducing of the second refrigerant into the at least one second cooling lance or the several second cooling lances after the production of the contiguous ice body.

5. The method according to claim 1, characterized in that the first refrigerant is a brine.

6. The method according to claim 1, characterized in that the second refrigerant is liquid nitrogen.

7. The method according to claim 1, characterized in inserting the first cooling lances into the ground region adjacent to one another along a plane in order to produce an ice body in the form of a pit wall.

8. The method according to claim 1, characterized in inserting the first cooling lances into the ground region adjacent to one another along a circumferential surface in order to produce an ice body in the form of a tunnel section.

9. The method according to claim 1, characterized in inserting the at least one second cooling lance or the several second cooling lances respectively into the ground region upstream of an assigned first cooling lance referred to a flow direction or flow, wherein the respective second cooling lance extends parallel to the assigned first cooling lance.

10. The method according to claim 1, characterized in that the fluidic flow medium is in the form of groundwater.

11. The method according to claim 5, characterized in that the brine is a calcium chloride solution.

12. The method according to claim 7, characterized in that the first cooling lances are parallel to one another.

13. The method according to claim 8, characterized in that the first cooling lances are parallel to one another.

* * * * *